US007808308B2

(12) United States Patent
Lai et al.

(10) Patent No.: US 7,808,308 B2
(45) Date of Patent: Oct. 5, 2010

(54) VOLTAGE GENERATING APPARATUS

(75) Inventors: Cheng-Hsiao Lai, Chiayi County (TW); Yuan-Che Lee, Taichung (TW); Tsung-Chien Wu, Hualien County (TW)

(73) Assignee: United Microelectronics Corp., Science-Based Industrial Park, Hsinchu (TW)

( * ) Notice: Subject to any disclaimer, the term of this patent is extended or adjusted under 35 U.S.C. 154(b) by 0 days.

(21) Appl. No.: 12/372,136

(22) Filed: Feb. 17, 2009

(65) Prior Publication Data

US 2010/0207686 A1 Aug. 19, 2010

(51) Int. Cl.
*G05F 1/10* (2006.01)

(52) U.S. Cl. ..... 327/541; 327/538

(58) Field of Classification Search ..... 327/538, 327/540, 541, 542, 543
See application file for complete search history.

(56) References Cited

U.S. PATENT DOCUMENTS 4,451,744 A * 5/1984 Adam ..... 323/313
4,609,833 A * 9/1986 Guterman ..... 327/537
4,800,297 A 1/1989 Novosel et al.
4,833,342 A * 5/1989 Kiryu et al. ..... 327/541
5,010,385 A * 4/1991 Shoemaker ..... 327/141
5,281,906 A * 1/1994 Thelen, Jr. ..... 323/313
5,751,142 A * 5/1998 Dosho et al. ..... 323/316
5,757,226 A * 5/1998 Yamada et al. ..... 327/541
5,825,695 A * 10/1998 Hamaguchi ..... 365/189.09
6,229,384 B1 * 5/2001 Ohsawa ..... 327/541
6,424,205 B1 7/2002 Kadanka
6,472,929 B2 * 10/2002 Kobayashi et al. ..... 327/540
6,653,694 B1 * 11/2003 Osanai ..... 257/392
6,975,164 B1 * 12/2005 Matsui et al. ..... 327/541
2001/0012219 A1 * 8/2001 Lee et al. ..... 365/189.09
2007/0221996 A1 9/2007 Imura

* cited by examiner

*Primary Examiner*—Lincoln Donovan
*Assistant Examiner*—Thomas J Hiltunen
(74) *Attorney, Agent, or Firm*—Winston Hsu

(57) ABSTRACT

A voltage generating apparatus is disclosed. The voltage generating apparatus includes a first N-type transistor and an enhancement MOSFET transistor. The first N-type transistor has a first drain/source coupled to a first voltage, a second drain/source generating a first output voltage, and a gate coupled to a second voltage. The enhancement MOSFET transistor has a first drain/source coupled to the second drain/source of the first N-type transistor, and a second drain/source and a gate coupled to a second voltage. The first N-type transistor is a depletion metal oxide semiconductor field effect transistor (MOSFET).

17 Claims, 6 Drawing Sheets

VOLTAGE GENERATING APPARATUS

BACKGROUND OF THE INVENTION

1. Field of the Invention

The present invention generally relates to a voltage generating apparatus, and in particular, to a voltage generating apparatus with a temperature compensation capability.

2. Description of Related Art

In the current electronic products, there are always some irreplaceable analog circuits. Most of the analog circuits may require an accurate reference power supply for achieving a stable behaviour. Thus, many so-called band gap voltage generating apparatuses are introduced. The most important subject matter of these band gap voltage generating apparatuses is a self-compensation capability of the output voltage for a temperature change.

Referring to FIG. 1, a circuit diagram of a conventional voltage generating apparatus 100 with a temperature compensation capability is shown. The voltage generating apparatus 100 generates currents I1 and 12 by using a transistor M1 and a transistor M2, respectively. The current I1 is divided into a current $I_{1a}$ and a current $I_{1b}$, while the current I2 is divided into a current $I_{1a}$ and a current $I_{2b}$. The current $I_{1b}$ flows through a bipolarity transistor Q1 and generates a voltage $V_{EB1}$, and likewise, the current $I_{2b}$ flows through the bipolarity transistor Q2 and generates a voltage $V_{EB2}$. An amplifier AMP1 receives the above voltages $V_{EB1}$, $V_{EB2}$, and generates a band gap voltage VBG through an output consisting of a transistor M3 and a resistor R1.

This band gap voltage VBG has a positive temperature coefficient, so for achieving a compensation effect, a set of low pass filters 101 is connected in series behind the band gap voltage VBG in the voltage generating apparatus 100. The low pass filter 101 consisting of a capacitor and a resistor has a negative temperature coefficient, and thus, may efficiently generate a temperature compensation effect to the output voltage Vout, so that the output voltage Vout would not drift as the temperature changes.

However, the above voltage generating apparatus 100 has to use a particular number of capacitors and resistors, thus increasing the circuit area and cost. Furthermore, the architecture of this conventional voltage generating apparatus cannot increase both the power swing rejection ratio (PSRR) and the bandwidth, thus influencing the whole behaviour.

SUMMARY OF THE INVENTION

Accordingly, the present invention is directed to a voltage generating apparatus, which may efficiently increases the power swing rejection ratio (PSRR) and the bandwidth.

The present invention provides a voltage generating apparatus, which includes a first N-type transistor and an enhancement metal oxide semiconductor field effect transistor (MOSFET). The first N-type transistor has a gate, a first drain/source, and a second drain/source, in which the first drain/source is coupled to a first voltage, the second drain/source generates a first output voltage, and the gate is coupled to a second voltage. The enhancement MOSFET also has a gate, a first drain/source, and a second drain/source, in which the first drain/source is coupled to the second drain/source of the first N-type transistor, the second drain/source and the gate are coupled to the second voltage. Furthermore, the above first N-type transistor is a depletion MOSFET In an embodiment of the present invention, the enhancement MOSFET is a P-type enhancement MOSFET, and the gate of the P-type enhancement MOSFET coupled to the second drain/source of the P-type enhancement MOSFET.

In an embodiment of the present invention, the enhancement MOSFET is an N-type enhancement MOSFET, and the gate of the N-type enhancement MOSFET coupled to the first drain/source of the N-type enhancement MOSFET.

In an embodiment of the present invention, the voltage generating apparatus further comprising a level shifting circuit coupled to the drain/source of the first enhancement MOSFET for generating a supply voltage.

In an embodiment of the present invention, the level shifting circuit is a transistor comprising a gate, a first drain/source, and a second drain/source. The gate of the first N-type transistor coupled to the first drain/source of the first N-type transistor, the first drain/source of the transistor coupled to a third voltage, and the second drain/source of the transistor generates the supply voltage.

In an embodiment of the present invention, the above voltage generating apparatus further includes M second N-type transistors, which are connected in series in a path of coupling the first drain/source of the first N-type transistor to the first voltage. Each second N-type transistor has a gate, a first drain/source, and a second drain/source, where M is a positive integer. In addition, the first drain/source of the 1st second N-type transistor is coupled to the first voltage, the second drain/source of the Mth second N-type transistor is coupled to the first drain/source of the first N-type transistor, and the gate of the Mth second N-type transistor is coupled to the second drain/source of the first N-type transistor. Further, the second drain/source of the ith second N-type transistor is coupled to the first drain/source of the i+1th second N-type transistor, and the gate of the ith second N-type transistor is coupled to the second drain/source of the i+1th second N-type transistor, where $1 \leqq i < M$, and i is an integer.

In an embodiment of the present invention, the above second N-type transistors are depletion MOSFETs.

In an embodiment of the present invention, the second drains/sources of the above second N-type transistors generate M second output voltages, respectively.

In an embodiment of the present invention, the above voltage generating apparatus further includes M+1 compensation resistors, which are connected in series between the second drains/sources of the first and second N-type transistors and the second voltage.

In an embodiment of the present invention, the above voltage generating apparatus further includes a level shifting circuit, which is coupled to the second drain/source of the first N-type transistor. The level shifting circuit receives a third voltage and the first output voltage, and generates a supply voltage.

In an embodiment of the present invention, the above voltage generating apparatus further includes a transistor. The transistor has a gate, a first drain/source, and a second drain/source, in which the gate is coupled to the second drain/source of the first N-type transistor, the first drain/source is coupled to the second drain/source of one of the second N-type transistors, and the second drain/source generates a supply voltage.

In an embodiment of the present invention, the above transistor is a depletion N-tune MOSFET.

In an embodiment of the present invention, the above voltage generating apparatus further includes a voltage reference circuit, which is coupled to the level shifting circuit and receives the supply voltage. The voltage reference circuit generates a reference output voltage according to the supply voltage.

In an embodiment of the present invention, the above voltage generating apparatus further includes a compensation resistor, which is coupled between the second drain/source of the first N-type transistor and the second voltage.

In an embodiment of the present invention, the above first voltage is a system voltage.

In an embodiment of the present invention, the above second voltage is a ground voltage.

As described above, the present invention achieves the temperature compensation effect by using a negative temperature coefficient of the depletion N-type MOSFET in combination with a positive temperature coefficient of the enhancement P-type MOSFET. More importantly, the voltage generating apparatus of the present invention may efficiently increase the PSRR and the bandwidth thereof. The voltage generating apparatus of the present invention does not need any external capacitor or resistor, and may efficiently reduce the circuit area, thereby saving the cost. Also, the voltage generating apparatus of the present invention does not require a too high operation voltage, and consume a little power.

To make the above features and advantages of the present invention more apparent, some embodiments are described in detail with reference to the accompanying drawings as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
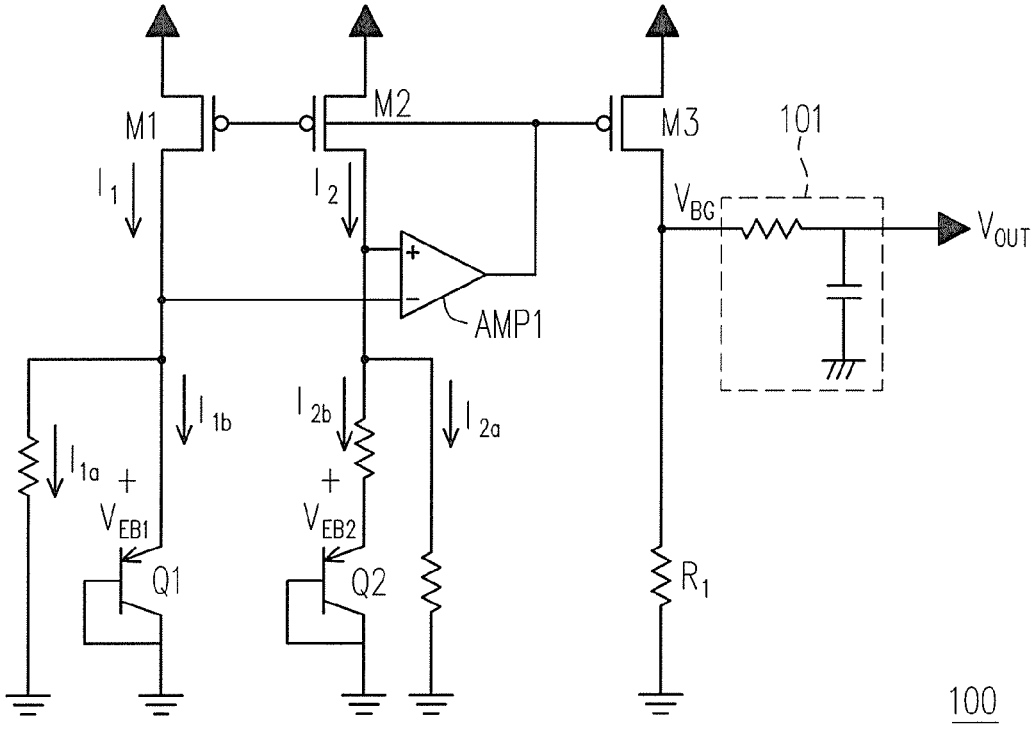
FIG. 1 (PRIOR ART)
FIG. 1 shows a circuit diagram of a conventional voltage generating apparatus 100 with a temperature compensation capability.

Reference will now be made in detail to the present embodiments of the invention, examples of which are illustrated in the accompanying drawings. Wherever possible, the same reference numbers are used in the drawings and the description to refer to the same or like parts.

First Embodiment

Figure 2:
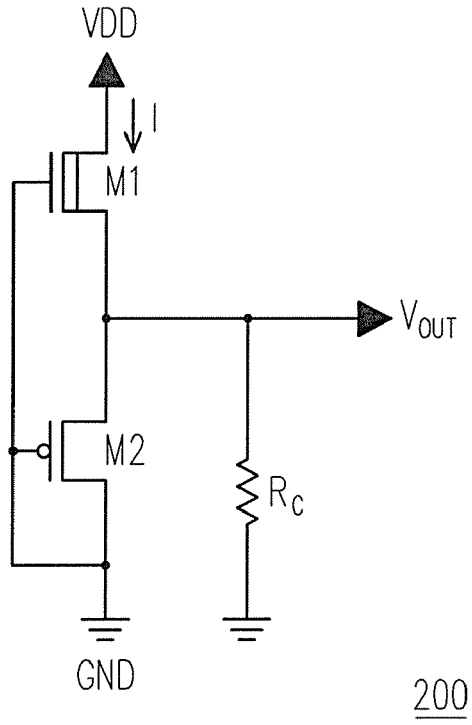
FIG. 2 shows a circuit diagram of a voltage generating apparatus 200 according to a first embodiment of the present invention.

Referring to FIG. 2 at first, a circuit diagram of a voltage generating apparatus 200 according to a first embodiment of the present invention is shown. The voltage generating apparatus 200 includes a transistor M1 and a transistor M2. The transistor M1 is an N-type depletion metal oxide semiconductor field effect transistor (MOSFET). The transistor M2 is a P-type enhancement MOSFET.

The transistor M1 has a gate, a first drain/source, and a second drain/source. The first drain/source of the transistor M1 is coupled to a first voltage VDD, and the second drains/source of the transistor M1 generates an output voltage Vout. Further, the gate of the transistor M1 is coupled to a second voltage GND. In this embodiment, the first voltage VDD is a system voltage, and the second voltage GND is a ground voltage.

In the whole action of the circuit, the voltage generating apparatus 200 generates a current I on a path of connecting the transistor M1 and the transistor M2 in series. Taking the transistors M1, M2 both working in a saturation region for example, the current I may be expressed as the equation (1):

$$I=k_1(V_{gs1}-V_{th1})^2=k_2(V_{sg2}-|V_{th2}|)^2 \tag{1}$$

In which, $V_{gs1}$, $V_{sg2}$ are a gate-source voltage difference of the transistor M1 and a source-gate voltage difference of the transistor M2, respectively. Further, $V_{th1}$, $V_{th2}$ are threshold voltages of the transistors M1, M2, respectively. The above characteristic parameters $k_1$, $k_2$ are the characteristic parameters of the transistor M1, M2, respectively, where $$k_1=(\mu_1\times C_{ox1}/2)(W_1/L_1)$$

$$k_2=(\mu_2\times C_{ox2}/2)(W_2/L_2)$$

$\mu_1$, $\mu_2$ are electron drift rates of the transistor M1 and hole drift rates of the transistor M2, $C_{ox1}$, $C_{ox2}$ are capacitance per unit area of the gate oxide layer of the transistors M1, M2, and $W_1/L_1$, $W_2/L_2$ are width-to-length ratios of the channel of the transistors M1, M2.

Continuing to refer to FIG. 2, as shown in FIG. 2, the source of the transistor M1 is connected with the source of the transistor M2, and the gate of the transistor M1 is connected with the gate of the transistor M2, so an equation (2) as follows is obtained.

$$V_{gs1}=-V_{sg2} \text{ and } V_{sg2}=V_{out} \tag{2}$$

The following equation (3) may be obtained by solving the simultaneous equations for the equation (1) and the equation (2):

$$V_{out}=\frac{|V_{th2}|-\sqrt{\frac{k_1}{k_2}}V_{th1}}{\left[1+\sqrt{\frac{k_1}{k_2}}\right]} \tag{3}$$

If the characteristic parameters $k_1$, $k_2$ of the transistors M1, M2 are equal, the output voltage may further be shown as the equation (4):

$$V_{out}=\frac{|V_{th2}|+|V_{th1}|}{2} \tag{4}$$

It may be known from the equation (4) that the output voltage $V_{out}$ is equal to an average of the absolute value of the threshold voltages $V_{th1}$, $V_{th2}$ of the transistors M1, M2. Since the transistor M1 is an N-type depletion MOSFET, the threshold voltage $V_{th1}$ thereof has a negative temperature coefficient. In contrast, since the transistor M2 is a P-type enhancement MOSFET, the threshold voltage $V_{th2}$ thereof has a positive temperature coefficient. Therefore, the output voltage $V_{out}$ is a voltage that is insensitive to the temperature change.

It should be noted especially that the above transistors M1, M2 both working in the saturation region is only an example provided for this embodiment, so as to facilitate illustrating the principle and way of the temperature compensation of this embodiment, instead of limiting the present invention. In practice, the transistors M1, M2 of this embodiment work in different working areas (e.g., a linear region), and also have a temperature compensation function.

Further, the voltage generating apparatus 200 of this embodiment further includes a compensation resistor Rc, and the compensation resistor Rc is connected in series between the second drain/source of the transistor M1 and the second voltage GND. The compensation resistor Rc provides another current flowing path for compensating the characteristics mismatching between the transistors M1 and M2 due to the process drifting.

Second Embodiment

Figure 3:
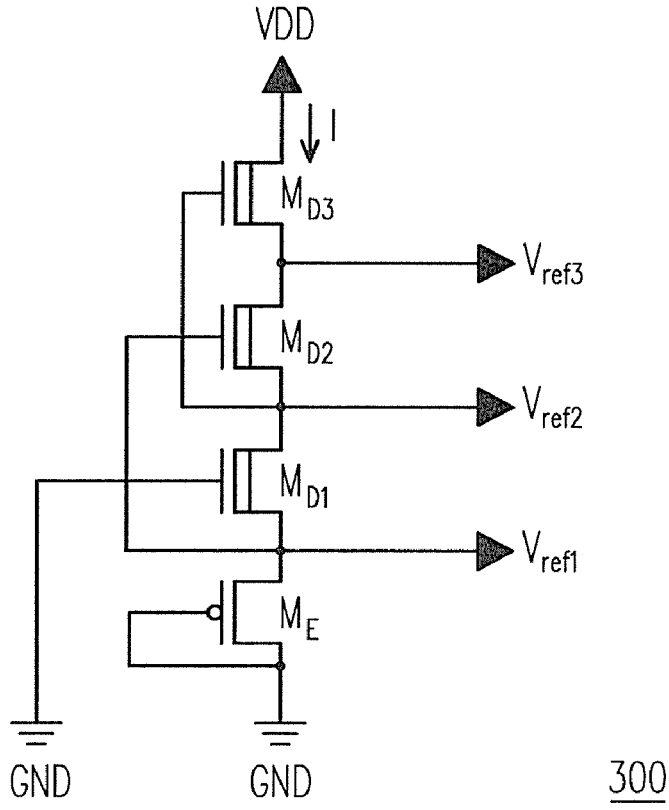
FIG. 3 shows a circuit diagram of a voltage generating apparatus 300 according to a second embodiment of the present invention.

Referring to FIG. 3, a circuit diagram of a voltage generating apparatus 300 according to a second embodiment of the present invention is shown. The voltage generating apparatus 300 includes a P-type transistor $M_E$ and a plurality of N-type transistors $M_{D1}$-$M_{D3}$. The P-type transistor $M_E$ is an enhancement MOSFET, and the N-type transistors $M_{D1}$-$M_{D3}$ are depletion MOSFETs.

The N-type transistors $M_{D2}$-$M_{D3}$ are connected in series in a path of coupling the first drain/source of the N-type transistor $M_{D1}$ to the first voltage VDD. The first drain/source of the N-type transistor $M_{D3}$ is coupled to the first voltage VDD, the gate is coupled to the second drain/source of the N-type transistor $M_{D2}$, and the second drain/source is coupled to the first drain/source of the N-type transistor $M_{D2}$. The second drain/source of the N-type transistor $M_{D2}$ is coupled to the first drain/source of the N-type transistor $M_{D1}$, and the gate of the N-type transistor $M_{D2}$ is coupled to the second drain/source of the N-type transistor $M_{D1}$.

It may be known from the first embodiment that an output voltage $V_{ref1}$ in the second embodiment should be equal to an average of the absolute values of the threshold voltages of the transistors $M_E$ and the transistor $M_{D1}$, as shown by the equation (5):

$$V_{ref1} = \frac{|V_{thE}| + |V_{thD1}|}{2} \tag{5}$$

VthE, VthD1 are the threshold voltages of the transistors $M_E$, $M_{D1}$, respectively.

Further, since the transistors $M_E$, $M_{D1}$-$M_{D3}$ are connected in series, the currents I flowing through the drains and sources of the transistor $M_{D1}$ and the transistor $M_{D2}$ should be equal. The equation (6) may be derived as follows:

$$k_{d1}(V_{gs1}-V_{thD1})^2=k_{d2}(V_{gs2}-V_{thD2})^2 \tag{6}$$

$k_{d1}$, $k_{d2}$ are the characteristic parameters of the transistor $M_{D1}$, $M_{D2}$, $V_{gs1}$ is a voltage across the drain and the source of the transistor $M_{D1}$, $V_{gs1}$ is a voltage across the drain and the source of the transistor $M_{D1}$. In other words, $V_{gs2}=V_{ref1}-V_{ref2}$, $V_{gs1}=0-V_{ref1}=-V_{ref1}$ (assuming that the second voltage GND is 0 V, and $V_{thD2}$ is the threshold voltage of the transistor MD2).

In the second embodiment, assuming that the transistors $M_{D1}$, $M_{D2}$ are two transistors fabricated with the same characteristics, the characteristic parameters $k_{d1}$, $k_{d2}$ in the equation (6) are equal, and the threshold voltages $V_{thD1}$, $V_{thD2}$ of the transistors $M_{D1}$, $M_{D2}$ are also equal. Therefore, a relationship between the output voltages $V_{ref1}$, $V_{ref2}$ may be derived in combination with the equations (5), (6). The relationship between the output voltages $V_{ref1}$, $V_{ref3}$ may be derived by using the same principle, where $2V_{ref1}=V_{ref2}$, and $3V_{ref1}=V_{ref3}$.

The voltage generating apparatus 300 in the present implementation has only one current path. Also, compared with the previous embodiment, a plurality of output voltages are added without adding any current path. That is to say, the voltage generating apparatus 300 may add several sets of output voltages without increasing the current consumption. On the other hand, like the first embodiment, the voltage generating apparatus 300 does not need to use any passive element such as a capacitor or a resistor, thereby efficiently reducing the circuit area. Moreover, the PSRR of the output voltage $V_{ref1}$ generated in the voltage generating apparatus 300 is also increased efficiently.

It is to be noted that, a 1:2:3 relationship of the output voltages $V_{ref1}$, $V_{ref2}$, $V_{ref3}$ illustrated in the embodiment of the voltage generating apparatus 300 does not mean that the voltage generating apparatus of the present invention may only generate the output voltages with such a proportional relationship. The voltage generating apparatus 300 may adjust the relationship among the output voltages $V_{ref1}$, $V_{ref2}$, $V_{ref3}$ by changing the characteristic relationship (the characteristic parameters and the threshold voltage) among the transistors $M_{D1}$, $M_{D2}$, $M_{D3}$.

Figure 4:
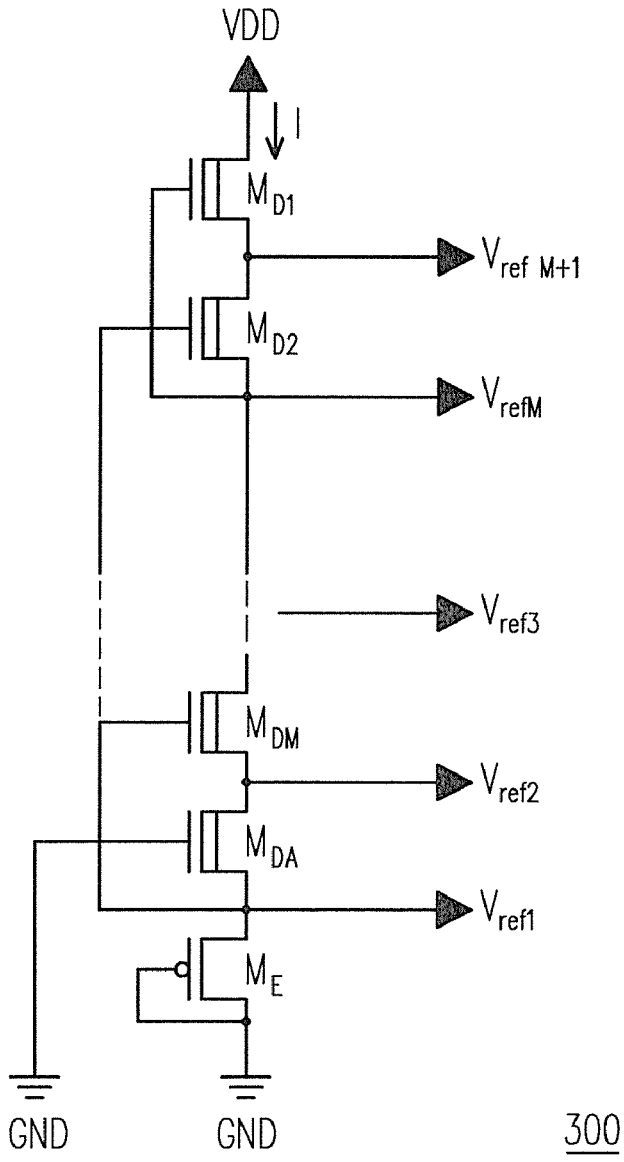
FIG. 4 shows a circuit diagram of another implementation of the voltage generating apparatus 300 according to the second embodiment of the present invention.

Further, the voltage generating apparatus 300 is not limited to connecting two transistors $M_{D2}$-$M_{D3}$ in series above the transistor $M_{D1}$. Referring to FIG. 4, a circuit diagram of another implementation of the voltage generating apparatus 300 according to the second embodiment of the present invention is shown. A plurality of (e.g, M, and M is a positive integer) transistors $M_{D1}$-$M_{DM}$ may be connected in series above the transistor $M_{D4}$. The first drain/source of the transistor $M_{D1}$ is coupled to the first voltage VDD, the second drain/source of the Mth transistor $M_{DM}$ is coupled to the first drain/source of the transistor $M_{D4}$, and the gate of the Mth transistor $M_{DM}$ is coupled to the second drain/source of the transistor $M_{D4}$. Furthermore, the second drain/source of the ith transistor $M_{Di}$ is coupled to the first drain/source of the i+1th second N-type transistor $M_{Di+1}$, the gate of the ith transistor $M_D$, is coupled to the second drain/source of the i+1th transistor $M_{Di+1}$, where $1 \leqq i < M$, and i is an integer. The voltage generating apparatus 300 may generate M+1 output voltages $V_{ref1}$-$V_{refM+1}$ in the implementation as shown by FIG. 4.

Also, to compensate for the difference among the transistors $M_{D2}$-$M_{DM+1}$, one compensation resistor may be connected in series on each terminal generating the output voltages $V_{ref1}$-$V_{refM+1}$ (the first drains/sources of the transistors $M_{D2}$-$M_{D4}$).

Third Embodiment

Figure 5:
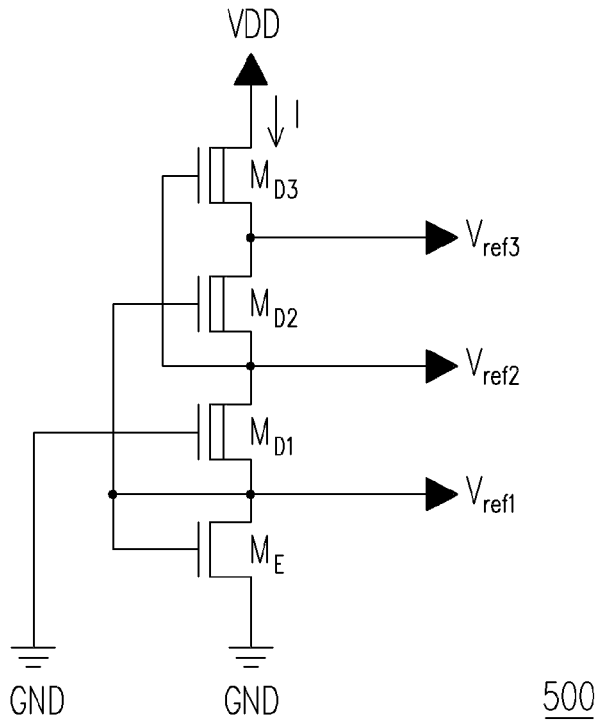
FIG. 5 shows a circuit diagram of a voltage generating apparatus 500 according to a third embodiment of the present invention.

Referring to FIG. 5, a circuit diagram of a voltage generating apparatus 500 according to a third embodiment of the present invention is shown. The voltage generating apparatus 500 includes a N-type transistor $M_E$ and a plurality of N-type transistors $M_{D1}$-$M_{D3}$. The N-type transistor $M_E$ is an enhancement MOSFET, and the N-type transistors $M_{D1}$-$M_{D3}$ are depletion MOSFETs.

In the voltage generating apparatus 500, the transistors $M_{D1}$-$M_{D3}$ are connected in series with each other. The first drain/source of the transistor $M_{D3}$ is coupled to the first voltage VDD, the gate of the transistor $M_{D3}$ is coupled to the second drain/source of the transistor $M_{D2}$, and the second drain/source of the transistor $M_{D3}$ is coupled to the first drain/source of the transistor $M_{D2}$. The gate of the transistor $M_{D2}$ is coupled to the second drain/source of the transistor $M_{D1}$, and the second drain/source of the transistor $M_{D2}$ is coupled to the first drain/source of the transistor $M_{D1}$. The gate of the transistor $M_{D1}$ is coupled to the second voltage GND, the second drain/source of the transistor $M_{D1}$ is coupled to the gate of the transistor $M_E$ and the first drain/source of the transistor $M_E$. Furthermore, the second drain/source of the transistor $M_E$ is coupled to the second voltage GND.

The voltage generating apparatus 500 may generate three output voltages $V_{ref1}$, $V_{ref2}$, $V_{ref3}$ as the voltage generating apparatus 300 in the second embodiment. Also, with the characteristic parameters and the threshold voltages of the transistors $M_{D1}$-$M_{D3}$ being the same, the ratio of the output voltages $V_{ref1}$, $V_{ref2}$, $V_{ref3}$ is also 1:2:3.

The voltage generating apparatus 500 may correspondingly generate more output voltages by connecting more N-type transistors in series, and the implementation thereof is similar to the related implementation of FIG. 4, and would not be further described in detail herein.

It is to be noted that, the voltage generating apparatus 500 does not need to use any passive element such as a capacitor or a resistor, thereby efficiently reducing the circuit area. Moreover, the PSRR of the output voltage $V_{ref1}$ generated in the voltage generating apparatus 500 is also increased efficiently.

Further, the 1:2:3 relationship of the output voltages $V_{ref1}$, $V_{ref1}$, $V_{ref3}$ illustrated in the embodiment of the voltage generating apparatus 500 does not mean that the voltage generating apparatus of the present invention may only generate the output voltages with such a proportional relationship. The voltage generating apparatus 500 may adjust the relationship among the output voltages $V_{ref1}$, $V_{ref2}$, $V_{ref3}$ by changing the characteristic relationship (the characteristic parameters and the threshold voltages) among the transistors $M_{D1}$, $M_{D2}$, $M_{D3}$.

Figure 6:
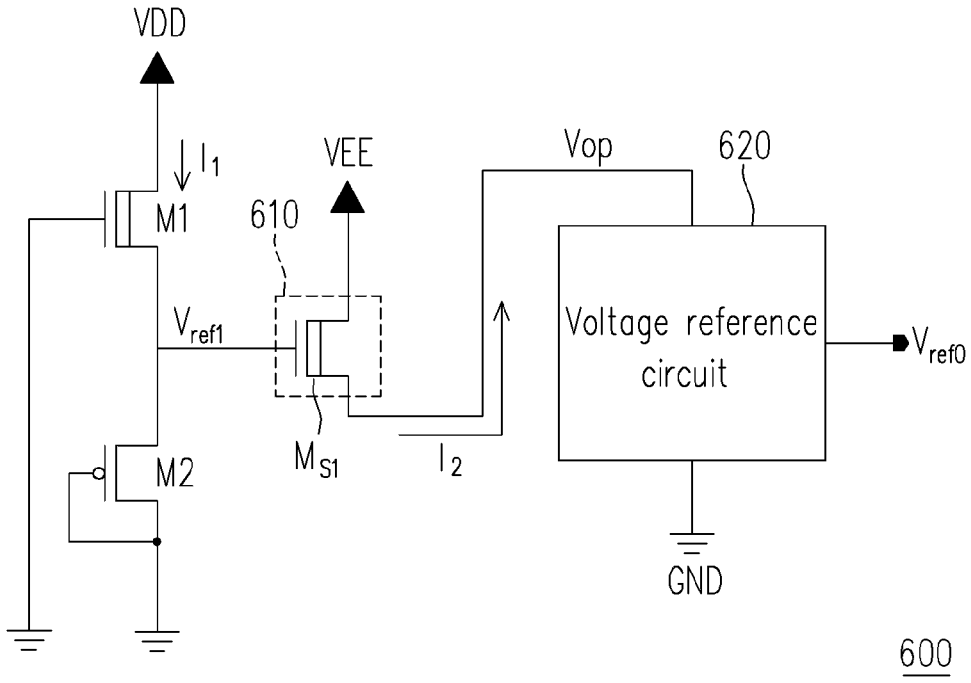
FIG. 6 shows a circuit diagram of a voltage generating apparatus 600 according to a fourth embodiment of the present invention.

Please notice here, the circuit constructed with transistor M1 and transistor M2 in voltage apparatus 600 shown in FIG. 6 can be replaced by the voltage generating apparatus 300 in FIG. 3, the voltage generating apparatus 400 in FIG. 4, or the voltage generating apparatus 500 in FIG. 5.

Fourth Embodiment

Referring to FIG. 6, a circuit diagram of a voltage generating apparatus 600 according to a fourth embodiment of the present invention is shown. The voltage generating apparatus 600 further includes a level shifting circuit 610 and a voltage reference circuit 620 in addition to the circuits mentioned in the first embodiment. The level shifting circuit 610 is coupled to the second drain/source of the N-type transistor M1. The level shifting circuit 610 receives the output voltage $V_{ref1}$ and a third voltage VEE, and generates a supply voltage Vop. The voltage reference circuit 620 is coupled to the level shifting circuit 610, receives the supply voltage Vop, and generates a reference output voltage $V_{refO}$.

Herein, the level shifting circuit 610 generates a supply voltage Vop suitable for a voltage level required by the voltage reference circuit 620 by adjusting the level of the output voltage $V_{ref1}$. Further, the level shifting circuit 610 may also generate a new current I2 different from the currents I1 flowing through the transistor M1, M2, so as to meet the requirement of the voltage reference circuit 620. That is to say, when the voltage reference circuit 620 requires a supply voltage Vop with a larger current, the level shifting circuit 610 may be designed correspondingly to drive a larger current, so as to cope with the requirement of the voltage reference circuit 620. In contrast, when the voltage reference circuit 620 requires a supply voltage Vop with a smaller current, the level shifting circuit 610 may be designed correspondingly to drive a smaller current, so as to save the power consumption.

The level shifting circuit 610 may be implemented with different transistors. In this embodiment, the level shifting circuit 610 is a depletion N-type MOSFET $M_{s1}$. The gate of the transistor $M_{s1}$ is coupled to the second drain/source of the transistor M1, the first drain/source of the transistor $M_{s1}$ receives the third voltage VEE, and the second drain/source of the transistor $M_{s1}$ generates a supply voltage Vop.

The voltage reference circuit 620 may be any device capable of generating a voltage, such as a voltage regulator and a power converter. It should be noted that, the PSRR and the bandwidth of the voltage generating apparatus 600 may be increased efficiently with this architecture.

Fifth Embodiment

Figure 7:
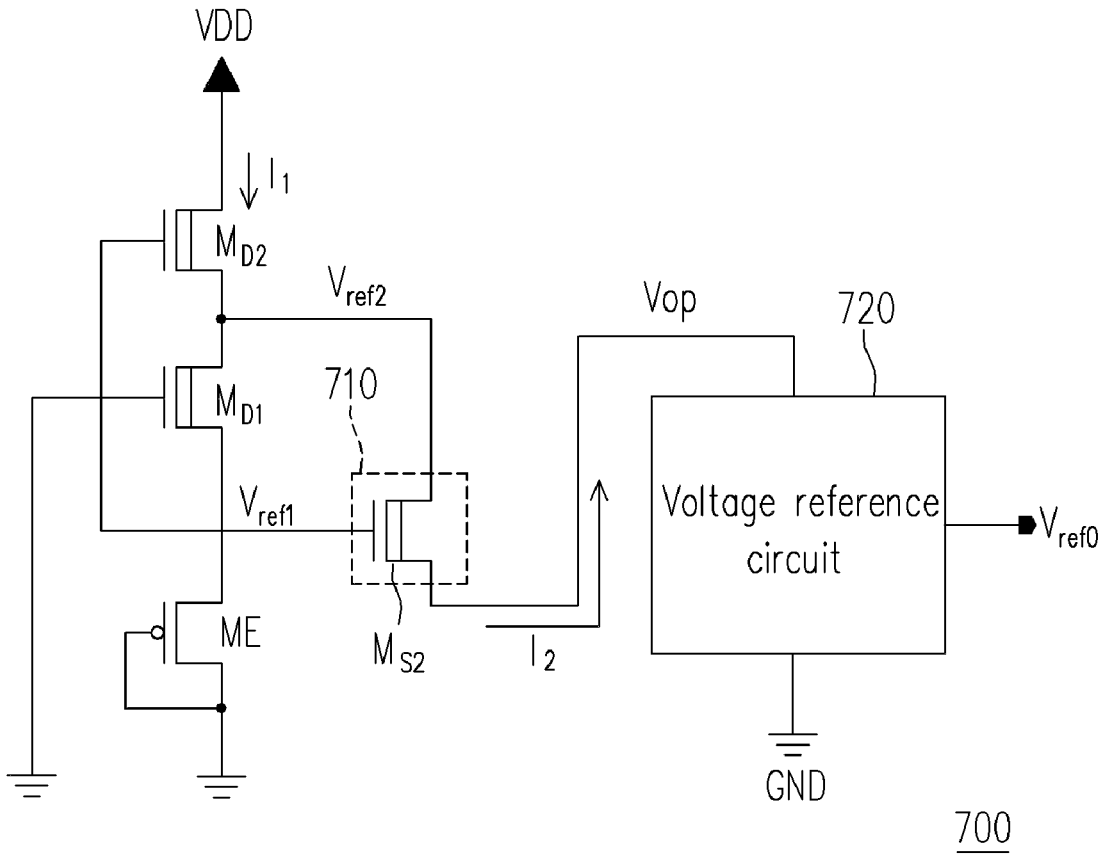
FIG. 7 shows a circuit diagram of a voltage generating apparatus 700 according to a fifth embodiment of the present invention.

Referring to FIG. 7, a circuit diagram of a voltage generating apparatus 700 according to a fifth embodiment of the present invention is shown. The voltage generating apparatus 700 includes a level shifting circuit 710 and a voltage reference circuit 720, in addition to the similar circuits mentioned in the second embodiment. The level shifting circuit 710 is coupled to the second drains/sources of the transistor $M_{D2}$ and the transistor $M_{D1}$. The level shifting circuit 710 receives the output voltages $V_{ref1}$, $V_{ref2}$, and generates a supply voltage Vop. The voltage reference circuit 720 is coupled to the level shifting circuit 710, receives the supply voltage Vop, and generates a reference output voltage $V_{refO}$.

Herein, the function of the level shifting circuit 710 is similar to the function of the level shifting circuit 610 in the fourth embodiment, except that the level shifting circuit 710 does not need the third voltage VEE.

The level shifting circuit 710 may also be implemented with different transistors. In this embodiment, the level shifting circuit 710 is a depletion N-type MOSFET $M_{s2}$. The gate of the transistor $M_{s2}$ is coupled to the second drain/source of the transistor $M_{D1}$, the first drain/source of the transistor $M_{s2}$ is coupled to the second drain/source of the transistor $M_{D2}$, and the second drain/source generates a supply voltage Vop. Herein, the PSRR and the bandwidth of the voltage generating apparatus 700 may be increased efficiently by this architecture.

In summary, the present invention generates an output voltage with a temperature compensation capability by the depletion N-type MOSFETs and the enhancement P-type MOSFETs which are connected in series. The voltage generating apparatus of the present invention does not need to use the capacitor and the resistor, thereby reducing the circuit area efficiently. Also, the present invention generates several sets of output voltages without adding the current outputs by connecting more depletion N-type MOSFETs in series, so that the PSRR of the first stage of the output voltages may be increased. Furthermore, the present invention may increase the bandwidth and the PSRR of the voltage generating apparatus by means of the level shifting circuit, and have both a low power consumption and a low cost.

Please notice here, the circuit constructed with transistor $M_{D1}$, $M_{D2}$ and transistor ME in voltage apparatus 700 shown in FIG. 7 can be replaced by the voltage generating apparatus 300 in FIG. 3, the voltage generating apparatus 400 in FIG. 4, or the voltage generating apparatus 500 in FIG. 5.

Although the present invention has been disclosed with the embodiments as above, it is not so limited. As apparent to those ordinary skilled in the art, some alternations and modifications may be made without departing from the sprit and scope of the present invention. Therefore, the protection scope of the present invention should be consistent with the one defined by the following claims.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage generating apparatus, comprising:

a first N-type transistor, comprising a gate, a first drain/source, and a second drain/source, the first drain/source being coupled to a first voltage, the second drain/source generating a first output voltage, and the gate being coupled to a second voltage;

an enhancement metal oxide semiconductor field effect transistor (MOSFET), comprising a gate, a first drain/source, and a second drain/source, the first drain/source being coupled to the second drain/source of the first N-type transistor, and the second drain/source and the gate being coupled to the second voltage, wherein the first N-type transistor is a depletion MOSFET; and M second N-type transistors, connected in series in a path of coupling the first drain/source of the first N-type transistor to the first voltage, each of the second N-type transistors comprising a gate, a first drain/source, and a second drain/source, wherein M is a positive integer;

wherein the first drain/source of the 1st second N-type transistor is coupled to the first voltage, the second drain/source of the Mth second N-type transistor is coupled to the first drain/source of the first N-type transistor, and the gate of the Mth second N-type transistor is coupled to the second drain/source of the first N-type transistor, and furthermore, the second drain/source of the ith second N-type transistor is coupled to the first drain/source of the i+1th second N-type transistor, the gate of the ith second N-type transistor is coupled to the second drain/source of the i+1th second N-type transistor, $1 \leqq i < M$, and i is an integer.

2. The voltage generating apparatus according to claim 1, the enhancement MOSFET is a P-type enhancement MOSFET, and the gate of the P-type enhancement MOSFET coupled to the second drain/source of the P-type enhancement MOSFET.

3. The voltage generating apparatus according to claim 1, the enhancement MOSFET is a N-type enhancement MOSFET, and the gate of the N-type enhancement MOSFET coupled to the first drain/source of the N-type enhancement MOSFET.

4. The voltage generating apparatus according to claim 1, further comprising:

a level shifting circuit, coupled to the first drain/source of the enhancement MOSFET for generating a supply voltage.

5. The voltage generating apparatus according to claim 4, wherein the level shifting circuit is a transistor comprising a gate, a first drain/source, and a second drain/source, the gate coupled to the second drain/source of the first N-type transistor, the first drain/source of the transistor coupled to a third voltage, and the second drain/source of the transistor generates the supply voltage.

6. The voltage generating apparatus according to claim 5, the transistor is a N-type depletion MOSFET.

7. The voltage generating apparatus according to claim 5, further comprising:

a voltage reference circuit, coupled to the level shifting circuit and for receiving the supply voltage, the voltage reference circuit generates a reference output voltage according to the supply voltage.

8. The voltage generating apparatus according to claim 1, wherein the second N-type transistors are depletion MOSFETs.

9. The voltage generating apparatus according to claim 1, wherein the second drains/sources of the second N-type transistors generate M second output voltages, respectively.

10. The voltage generating apparatus according to claim 1, further comprising:

M+1 compensation resistors, connected in series between the second drains/sources of the first and second N-type transistors and the second voltage, respectively.

11. The voltage generating apparatus according to claim 1, further comprising:

a level shifting circuit, coupled to the second drain/source of the first N-type transistor and the second drain/source of one of the second N-type transistors, wherein the level shifting circuit receives the first output voltage and one of the second output voltages, and generates a supply voltage.

12. The voltage generating apparatus according to claim 11, wherein the level shifting circuit is a transistor, which comprises a gate, a first drain/source, and a second drain/source, the gate is coupled to the second drain/source of the first N-type transistor, the first drain/source is coupled to the second drain/source of one of the second N-type transistors, and the second drain/source generates the supply voltage.

13. The voltage generating apparatus according to claim 12, wherein the transistor is a depletion N-type MOSFET.

14. The voltage generating apparatus according to claim 11, further comprising:

a voltage reference circuit, coupled to the level shifting circuit, and receiving the supply voltage, wherein the voltage reference circuit generates a reference output voltage according to the supply voltage.

15. The voltage generating apparatus according to claim 1, further comprising:

a compensation resistor, coupled between the second drain/source of the first N-type transistor and the second voltage.

16. The voltage generating apparatus according to claim 1, wherein the first voltage is a system voltage.

17. The voltage generating apparatus according to claim 1, wherein the second voltage is a ground voltage.

* * * * *